US007922372B2

(12) United States Patent
Li

(10) Patent No.: US 7,922,372 B2
(45) Date of Patent: Apr. 12, 2011

(54) LED STREET LAMP

(75) Inventor: Xuliang Li, Dongguan (CN)

(73) Assignee: Dongguan Kingsun Optoelectronic Co., Ltd., Hengjiangxia Village, Changping Town, Dongguan (CN)

( * ) Notice: Subject to any disclaimer, the term of this patent is extended or adjusted under 35 U.S.C. 154(b) by 236 days.

(21) Appl. No.: 12/438,726

(22) PCT Filed: Jan. 11, 2008

(86) PCT No.: PCT/CN2008/000077

§ 371 (c)(1),
(2), (4) Date: Feb. 24, 2009

(87) PCT Pub. No.: WO2009/012636

PCT Pub. Date: Jan. 29, 2009

(65) Prior Publication Data

US 2009/0237930 A1 Sep. 24, 2009

(30) Foreign Application Priority Data

Jul. 20, 2007 (CN) ..... 2007 2 0121560 U

(51) Int. Cl.
*F21V 29/00* (2006.01)
*F21V 21/00* (2006.01)

(52) U.S. Cl. ..... 362/373; 362/294; 362/249.02; 362/368; 362/431; 362/267

(58) Field of Classification Search ..... 362/431, 362/414, 249.02, 294, 373, 153, 153.1, 267, 362/374, 375, 368, 370
See application file for complete search history.

(56) References Cited

U.S. PATENT DOCUMENTS

| | | | | |
|---|---|---|---|---|
| 7,686,469 | B2 * | 3/2010 | Ruud et al. | 362/101 |
| 7,771,087 | B2 * | 8/2010 | Wilcox et al. | 362/294 |
| 7,824,070 | B2 * | 11/2010 | Higley et al. | 362/249.02 |
| 2006/0250803 | A1 * | 11/2006 | Chen | 362/373 |

* cited by examiner

*Primary Examiner* — Thomas M Sember

(57) ABSTRACT

A combined LED street lamp (100), comprises a lamp body and a LED bulb (107); the lamp body comprises a head portion (101), a middle portion (102), and a tail portion (103); a first gasket (104) is set between the head portion (101) and the middle portion (102), a second gasket (105) is set between the tail portion (103) and the middle portion (102); the head portion (101) and the tail portion (103) connect to the middle portion (102) with fasteners; the middle portion (102) is a profile which has the same cross section in different position along its length direction. Products with different size can be made by the same group of moulds.

11 Claims, 6 Drawing Sheets

LED STREET LAMP

FIELD OF THE INVENTION

The present invention relates to a LED street lamp, in particular to a combined LED street lamp.

BACKGROUND OF THE INVENTION

LED street lamp has been used as a replacement of traditional street lamp due to its desirable properties of good color degree, without maintenance, and long service life, and importantly energy saving. Currently, great efforts have been made by many international companies in illumination industry in order to develop a high-power LED street lamp, but with few successes. Most of new developed street lamps use traditional street lamp as the lamp body, and is combined with a fan to radiate heat into the surrounding space. However, the fan results in an unstable radiation effect, and the fan itself usually has a short service life and always needs to be maintained, and is energy consuming.

Moreover, each product (either stamping with hardware or die casting molding) with different size, only can be manufactured by different special moulds, which increases the manufacturing cost, and therefore, the popularization and application of high power LED street lamp is limited.

SUMMARY OF THE INVENTION

To overcome these shortcomings in the prior art, one object of the present invention is to provide a combined LED street lamp with good heat diffusion property, and product with different size can be made by the same group of moulds.

To achieve the object, the present invention provides a combined LED street lamp comprising:

a lamp body and LED bulbs, wherein the lamp body comprises a head portion, a middle portion, and a tail portion, wherein the head portion is disposed opposite to one end of the middle portion, and the tail portion is disposed opposite to the other end of the middle portion; a first gasket is sandwiched between the head portion and the middle portion, and the head portion connects to the middle portion through a fastener; a second gasket is sandwiched between the tail portion and the middle portion, and the tail portion connects to the middle portion through another fastener;

the middle portion is a profile which has the same cross section in different positions along its length direction; the profile has a flat shaped substrate extending along the length direction of the profile, said substrate has a front surface and a back surface; two side plates are set on two edges of the front surface, and a plurality of heat diffusion wings are disposed on the back surface of the substrate;

the street lamp 100 also comprises a heat conduction floor with printed circuit, and a plurality of LED bulbs are set on the floor to form a LED array board; the side opposite to the side set with the LED bulb of the heat conduction floor is in close contact with the front surface of the substrate of the middle portion;

the LED street lamp further comprises secondary optical lens placed on a lens board via snap joints; said lens board runs parallel to the LED array board, and each LED lamp corresponds to one secondary optical lens; a plurality of supports with the same height are set on a side of the lens board opposite to the LED array board; said supports extend to the heat conduction floor, and the lens board and the heat conduction floor are fixed to the front surface of substrate through fastener;

the head portion of the lamp body has a first transverse plate that is placed at an end where the head portion connects with the middle portion; the tail portion of the lamp body has a second transverse plate that is placed at an end where the tail portion connects with the middle portion; said first transverse plate, second transverse plate, the two side plates of the front surface of the middle portion, and the front surface of middle portion define a cavity, where the front surface of middle portion forms the bottom of the cavity, and the first transverse plate, the second transverse plate, and the two side plates form the walls of the cavity; one side of the transverse plates and the side plates is formed steps thereon which are used for holding a lampshade;

the head portion has a section of pipe with the axis of the pipe perpendicular to the first transverse plate; said first transverse plate has wire holes, and the side wall of the pipe has threaded holes; and the head portion, the middle portion, and the tail portion are all made of material with good heat conductivity; said LED street lamp further comprises a lampshade disposed with the use of the steps, and a third gasket is disposed between the lampshade and lamp body.

A LED street lamp, wherein the LED array board comprises a plurality of LED subarray board, with each LED subarray board being set a group of LED bulbs thereon, and each LED subarray board connecting to the front surface of middle portion by fastener.

A LED street lamp, wherein the lens board 108 consists of a plurality of lens subfloors, with each lens subfloor being set a group of secondary optical lens thereon, and each lens subfloor connecting to the front surface of substrate of middle portion by fastener.

A LED street lamp, wherein the LED street lamp further comprises constant current source which is set in the cavity defined by the lamp body and the lampshade; the constant current source is set near to the head portion; the constant current source comprises a plurality of groups of constant current device operating independently; the output terminal of each group of constant current device electrically connects to the corresponding LED subarray board; and each group of constant current devices shares a public input terminal which electrically connects to the source device.

A LED street lamp, wherein a waterproof joint is disposed adjacent to the wire hole.

A LED street lamp, wherein the head portion and the tail portion contact with each other through the screws set in the intervals of heat diffusion wings.

A LED street lamp, wherein there are ridges set on the outer surface of the pipe and the threaded holes are disposed in the ridges.

A LED street lamp, wherein the side plates of the middle portion are symmetrically attached on both sides and extend along the length direction of the profile; the cross section of each side plate is of a hook shape, and the root of the hook forms on the edge of front surface, and the tips of the hooks of both side plates are oppositely set; the tip has a rectangle shape with a first plane runs parallel to the front surface, a second plane perpendicular to the first plane, and a third plane which is far away from front compared with the first plane runs parallel to the first plane; the second plane and the first plane define a first edge, and the second plane and the third plane define a second edge; there is a fourth plane which is perpendicular to the third plane and defines a right angle with the third plane; the fourth plane runs parallel to the second plane, and the fourth plane is far away from hook tips compared with the second plane; the third plane and the fourth plane define the steps; the heat diffusion wing of the middle portion has a plate shape and is perpendicular to the substrate; the heat diffusion wings extend along the length direction of the profile, and each heat diffusion wing runs parallel or nearly parallel, or the heat diffusion wings are radially arranged on the substrate; and the heat diffusion wings are arranged on the whole area of the back surface of the substrate.

A LED street lamp, wherein the side of the first transverse plate which faces towards the middle portion has two projecting positioning plates which are to be inserted into the clearance defined by the hook and the substrate; and another two positioning plates are also formed on the second transverse plate and function similarly; and a plurality of round holes are formed on the front of the middle portion which are used as bottom holes for connection of the head portion with middle portion, or the tail portion with the middle portion.

A LED street lamp, wherein the surface of the heat diffusion wings has a plurality of projecting heat dissipation edge set along the length of the profile.

A LED street lamp, wherein the head portion and the tail portion is made of aluminum or aluminum alloy by technique of die casting, and the middle portion is aluminum or aluminum alloy profile.

The head portion and tail portion of LED street lamp in present invention can be made to be a standard module which is adapted for products with different size but have the same width. The middle portion is a profile which has the same cross section in different position along its length direction, and therefore, it can be cut to different length based on the actual needs. The same series with different size production can be produced with only one group of moulds.

The head portion, middle portion, and the tail portion of LED street lamp in present invention are made of heat conduction materials. The heat diffusion wings setting in back of middle portion are easy to disperse heat produced by LED lamp into the air compared to the fan used in the conventional street lamp. The present street lamp has less chance to go wrong and thus is easy to be maintained.

BRIEF DESCRIPTION OF THE DRAWINGS

The present invention will be described in detail with reference to the accompany drawings, in which.

DETAILED DESCRIPTION OF THE INVENTION

Figure 1:
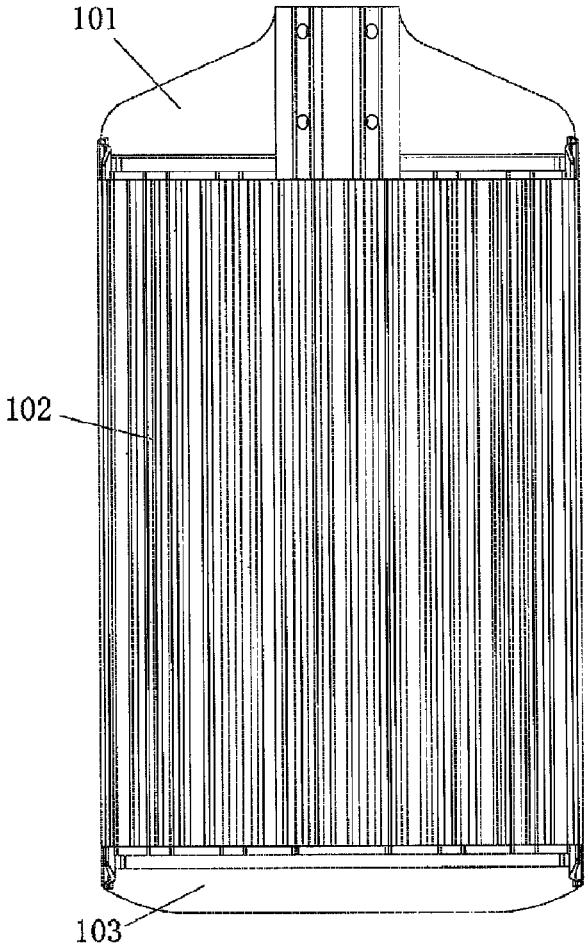
FIG. 1 is a vertical view of a first embodiment of the present invention.
Figure 2:
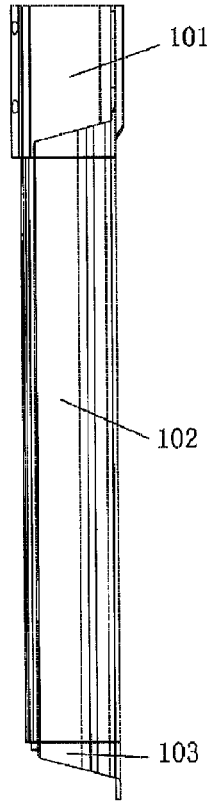
FIG. 2 is a side view of the first embodiment of the present invention.
Figure 3:
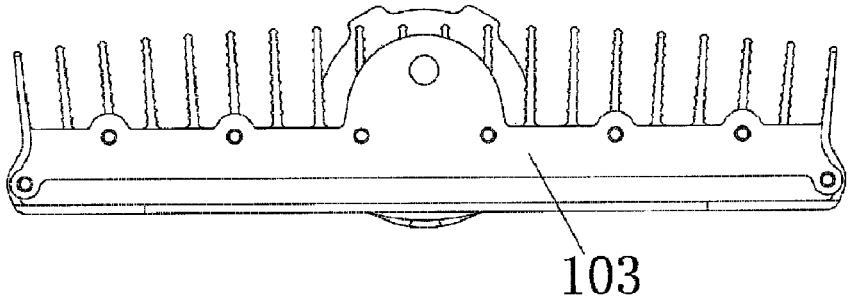
FIG. 3 is a front view of the first embodiment of the present invention.
Figure 4:
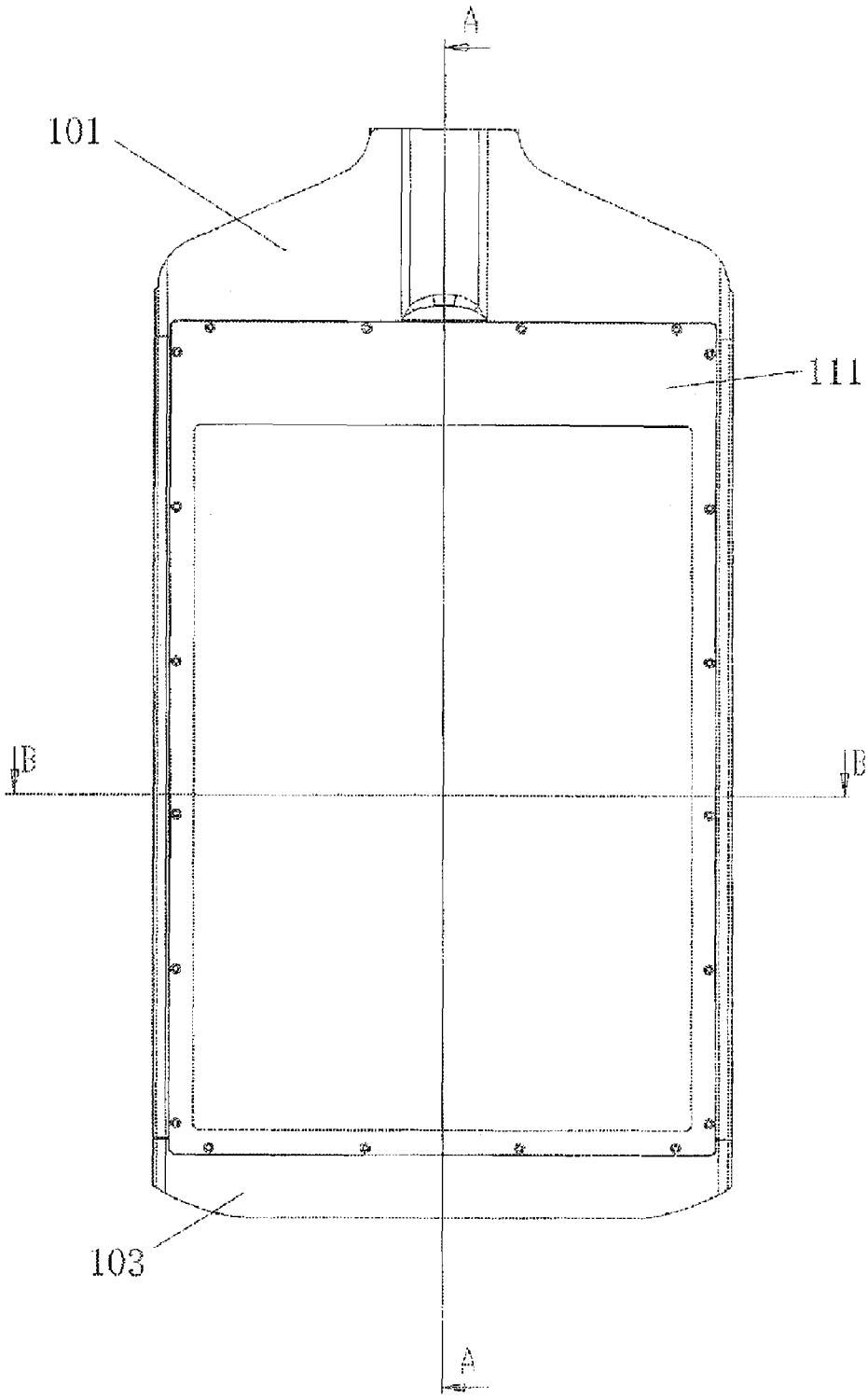
FIG. 4 is a bottom view of the first embodiment of the present invention.

In a first embodiment of the present invention is provided a LED street lamp as shown in FIG. 1-8. The LED street lamp 100 comprises a lamp body and a LED bulb 107. The lamp body comprises a head portion 101, a middle portion 102, and a tail portion 103. The head portion 101 is disposed opposite to one end of the middle portion 102, and the tail portion 103 is disposed opposite to the other end of the middle portion 102. A gasket 104 is sandwiched between the head portion 101 and the middle portion 102, and a gasket 105 is sandwiched between the tail portion 103 and the middle portion 102. The head portion 101 and the tail portion 103 both connect to the middle portion 102 through screws.

The middle portion 102 is a profile which has the same cross section in different position along their lengths. The profile has a flat shaped substrate extending along the length direction of the profile. The substrate has two surfaces, that is, a front surface and a back surface. Two side plates are set on two edges of the front surface, and a plurality of heat diffusion wings 1021 is disposed on the back surface of the substrate.

The street lamp 100 also comprises a heat conduction floor 106 with printed circuit, and a plurality of LED bulbs 107 are set on the floor 106 to form a LED array board. The side opposite to the side set with the LED bulb 107 of the heat conduction floor 106 is in close contact with the front surface of the substrate of the middle portion 102.

The LED street lamp further comprises secondary optical lens 109 placed on a lens board 108 via snap joints. The lens board 108 runs parallel to the LED array board, and each LED lamp 107 corresponds to one secondary optical lens 109.

A plurality of supports with the same height are set on a side of the lens board 108 opposite to the LED array board. In a preferable example, the supports are cylinders with the same height. Each of the cylinders has a through hole therein and the heat conduction floor 106 also has a hole opposite to the through hole in the cylinder. These holes are designed for perforation. The other side of the lens board has a counterbore in the place opposite to the supports for the placement of the screw head. The supports extend to the heat conduction floor 106, and the lens board 108 and the heat conduction floor 106 are fixed to the front surface of substrate through screws.

The head portion 101 of the lamp body has a first transverse plate that is placed at an end where the head portion 101 connects with the middle portion 102. The tail portion 103 of the lamp body has a second transverse plate that is placed at an end where the tail portion 103 connects with the middle portion 102. The first transverse plate, the second transverse plate, the two side plates of the front surface of the middle portion 102, and the front surface of middle portion 102 define a cavity, where the front surface of middle portion 102 forms the bottom of the cavity, and the first transverse plate, the second transverse plate, and the two side plates form the walls of the cavity. One side of the transverse plates and the side plates is formed steps thereon which are used for holding a lampshade 111.

Figure 5:
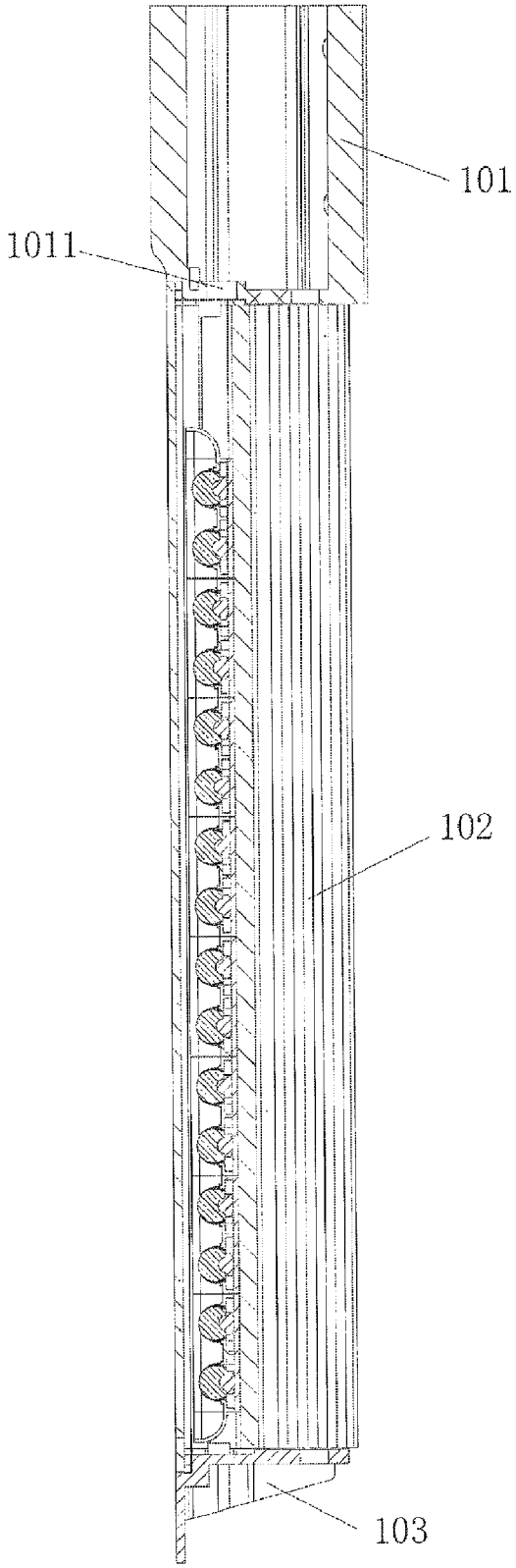
FIG. 5 is a sectional view along line A-A shown in FIG. 4.
Figure 6:
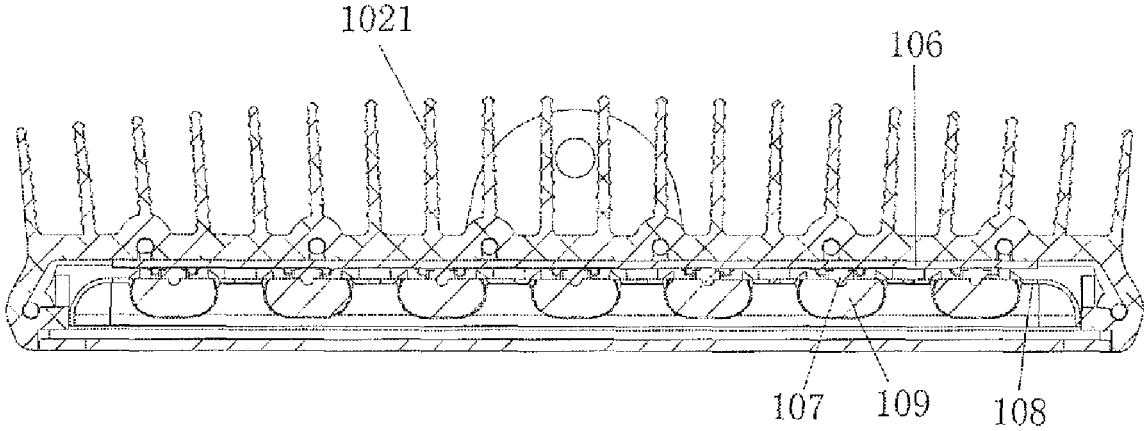
FIG. 6 is a sectional view along line B-B shown in FIG. 4.
Figure 7:
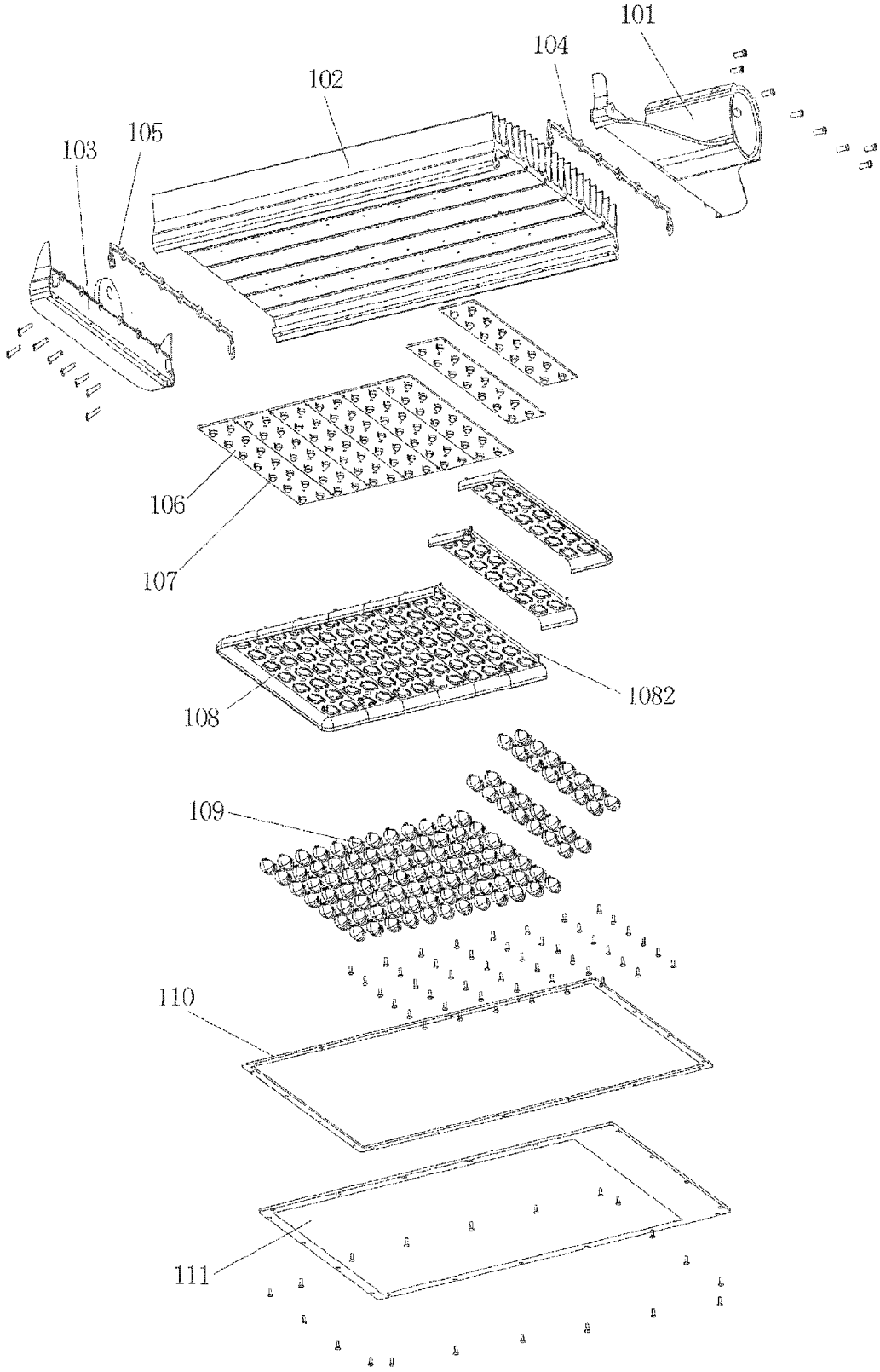
FIG. 7 is a schematic diagram of the first embodiment of the present invention.

The head portion 101 has a section of pipe with the axis of the pipe perpendicular to the first transverse plate. As shown in FIG. 5, the first transverse plate has wire holes 1011, and the side wall of the pipe has threaded holes which are used to lock the LED lamp to streetlight pole. In this example, there are ridges set on the outer surface of the pipe and the threaded holes are disposed in the ridges.

The head portion 101, the middle portion 102, and the tail portion 103 are all made of aluminum material with good heat conduction property. The LED street lamp further comprises a lampshade 111 disposed with the use of the steps, and a gasket 110 is disposed between the lampshade and lamp body.

The LED array board consists of a plurality of LED subarray boards. Each LED subarray board is set a group of LED bulbs thereon, and each LED subarray board connects to the front surface of middle portion 102 by screws. The LED bulbs on each LED subarray board form a LED module; correspondingly, the lens board 108 consists of a plurality of lens subfloors. Each lens subfloor is set a group of secondary optical lens thereon, and each lens subfloor connects to the front surface of substrate of middle portion 102 by screws.

The LED street lamp further comprises constant current source which is set in the cavity defined by the lamp body and the lampshade 111. Preferably, the constant current source is set near to the bead portion 101. The constant current source comprises a plurality of groups of constant current device operating independently. The output terminal of each group of constant current device connects to the corresponding LED subarray board by wires for power supply to each corresponding module. Each group of constant current devices shares a public input terminal which connects to the source device through wires. In this example, the LED bulbs in each module are in parallel connection, and the working voltage of module is 48V and the power of each LED bulb is 1 W. Obviously, the LED bulbs in LED module can be connected in series or connected in any other suitable forms, and the working voltage of module can be 36V or 220V.

In this example, a waterproof joint is disposed adjacent to the wire hole 1011 to make a dry cavity. The side plates of the middle portion 102 are symmetrically attached on both sides and extend along the length direction of the profile. The cross section of each side plate is of a hook shape, and the root of the hook forms on the edge of front surface, and the tips of the hooks of both side plates are oppositely set. Specifically, the tip has a rectangle shape with a first plane runs parallel to the front surface, a second plane perpendicular to the first plane (thus, to the front surface), and a third plane which is far away from front compared with the first plane runs parallel to the first plane. The second plane and the first plane define a first edge, and the second plane and the third plane define a second edge. Further, there is a fourth plane which is perpendicular to the third plane and defines a right angle with the third plane. The fourth plane runs parallel to the second plane, and the fourth plane is far away from hook tips compared with the second plane. The third plane and the fourth plane define the steps.

The heat diffusion wing 1021 of the middle portion 102 has a plate shape and is perpendicular to the substrate. The heat diffusion wings 1021 extend along the length direction of the profile, and each heat diffusion wing 1021 runs parallel or nearly parallel, or the heat diffusion wings 1021 are radially arranged on the substrate. The heat diffusion wings are arranged on the whole area of the back surface of the substrate.

In a preferable example, the surface of the heat diffusion wings 1021 has a plurality of projecting heat dissipation edge set along the length of the profile. One side of the first transverse plate which faces towards the middle portion 102 has two projecting positioning plates. The positioning plates are to be inserted into the clearance defined by the hook and the substrate. Another two positioning plates are also formed on the second transverse plate and function similarly.

Figure 8:
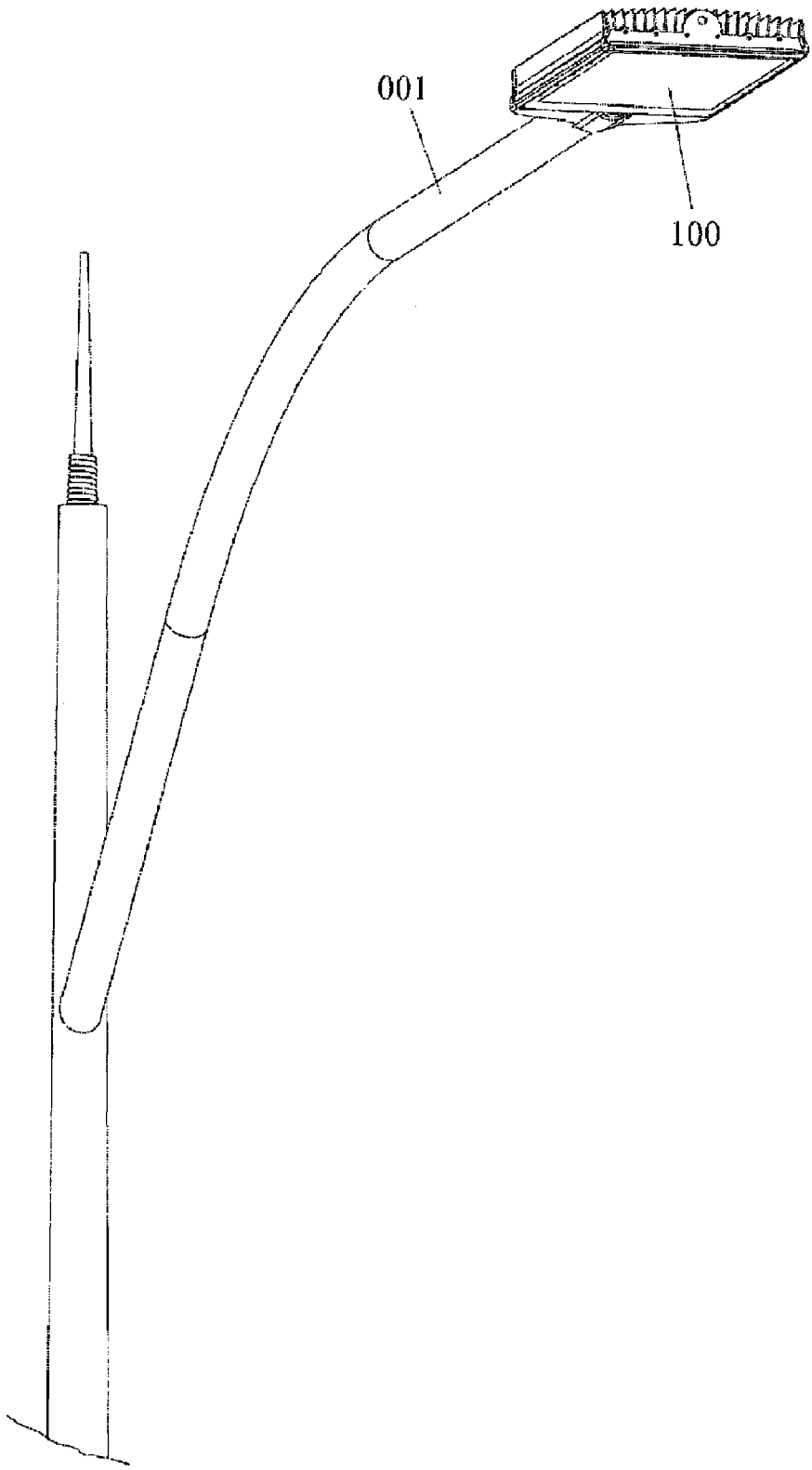
FIG. 8 is a schematic diagram showing the street lamp of the present invention installed on a lamp post.

A plurality of round holes are formed on the front of the middle portion 102. The holes are used as bottom holes for connection of the head portion 101 with middle portion 102, or the tail portion 103 with the middle portion 102. As shown in FIG. 8, the LED lamp 100 in the present invention is installed to the streetlight pole 001 through the pipe in the head portion 101. Lines for power supply are distributed inside of the streetlight pole 001, and connect with the source device placed under the streetlight pole 001.

A second embodiment of the present invention further provides a LED street lamp with the same structure as in the first embodiment except that the middle portion of LED street lamp is longer than that in the first embodiment, and the head portion and tail portion are made of aluminum alloy by way of die casting, and the middle portion is an aluminum alloy profile. The head portion and the tail portion contact with each other through the screws set in the intervals of heat diffusion wings.

A third embodiment of the present invention further provides a LED street lamp with the same structure as in the first embodiment except that the supports in lens board are strips with the same height. The supporting face between the strip and the heat conductor floor is a flat plane. The strips and the secondary optical lens are staggered. There are holes with a counterbore formed in the lens board for mounting screw. The counterbore is set far away from the strip in lens board. The supports extend to the heat conduction floor and make the lens board and the heat conductor floor equally distant. The lens board and the heat conductor floor connect to the front of substrate by way of screws.

INDUSTRIAL APPLICABILITY

The invention can be manufactured by technical means known by the person skilled in the art. Disclosed herewith are preferable embodiments of the present invention, and any changes or modifications (for example, different changes on the shape or the number of the heat diffusion wings) made to the disclosed embodiments within the spirit of the present invention will be obvious to the skilled person. Applicant is intended to include all these changes or modifications within the scope of the present invention defined by the accompany claims.

What is claimed is:

1. A LED street lamp, comprising a lamp body and LED bulbs, wherein the lamp body comprises a head portion, a middle portion, and a tail portion, wherein the head portion is disposed opposite to one end of the middle portion, and the tail portion is disposed opposite to the other end of the middle portion; a first gasket is sandwiched between the head portion and the middle portion, and the head portion connects to the middle portion through a fastener; a second gasket is sandwiched between the tail portion and the middle portion, and the tail portion connects to the middle portion through another fastener;

the middle portion is a profile which has the same cross section in different positions along its length direction; the profile has a flat shaped substrate extending along the length direction of the profile, said substrate has a front surface and a back surface; two side plates are set on two edges of the front surface, and a plurality of heat diffusion wings are disposed on the back surface of the substrate;

the street lamp also comprises a heat conduction floor with printed circuit, and a plurality of LED bulbs are set on the floor to form a LED array board; the side opposite to the side set with the LED bulb of the heat conduction floor is in close contact with the front surface of the substrate of the middle portion;

the LED street lamp further comprises secondary optical lens placed on a lens board via snap joints; said lens board runs parallel to the LED array board, and each LED lamp corresponds to one secondary optical lens; a plurality of supports with the same height are set on a side of the lens board opposite to the LED array board; said supports extend to the heat conduction floor, and the lens board and the heat conduction floor are fixed to the front surface of substrate through fastener;

the head portion of the lamp body has a first transverse plate that is placed at an end where the head portion connects with the middle portion; the tail portion of the lamp body has a second transverse plate that is placed at an end where the tail portion connects with the middle portion; said first transverse plate, second transverse plate, the two side plates of the front surface of the middle portion, and the front surface of middle portion define a cavity, where the front surface of middle portion forms the bottom of the cavity, and the first transverse plate, the second transverse plate, and the two side plates form the walls of the cavity; one side of the transverse plates and the side plates is formed steps thereon which are used for holding a lampshade;

the head portion has a section of pipe with the axis of the pipe perpendicular to the first transverse plate; said first transverse plate has wire holes, and the side wall of the pipe has threaded holes; and the head portion, the middle portion, and the tail portion are all made of material with good heat conductivity; said LED street lamp further comprises the lampshade disposed with the use of the steps, and a third gasket is disposed between the lampshade and lamp body.

2. The LED street lamp of claim 1, wherein the LED array board comprises a plurality of LED subarray boards, with each LED subarray board being set a group of LED bulbs thereon, and each LED subarray board connecting to the front surface of middle portion by fastener.

3. The LED street lamp of claim 2, wherein the lens board 108 consists of a plurality of lens subfloors, with each lens subfloor being set a group of secondary optical lens thereon, and each lens subfloor connecting to the front surface of substrate of middle portion by fastener.

4. The LED street lamp of claim 2, wherein the LED street lamp further comprises constant current source which is set in the cavity defined by the lamp body and the lampshade; the constant current source is set near to the head portion; the constant current source comprises a plurality of groups of constant current device operating independently; the output terminal of each group of constant current device electrically connects to the corresponding LED subarray board; and each group of constant current devices shares a public input terminal which electrically connects to the source device.

5. The LED street lamp of claim 1, wherein a waterproof joint is disposed adjacent to the wire hole.

6. The LED street lamp of claim 1, wherein the head portion and the tail portion contact with each other through the screws set in the intervals of heat diffusion wings.

7. The LED street lamp of claim 1, wherein there are ridges set on the outer surface of the pipe and the threaded holes are disposed in the ridges.

8. The LED street lamp of claim 1, wherein the side plates of the middle portion are symmetrically attached on both sides and extend along the length direction of the profile; the cross section of each side plate is of a hook shape, and the root of the hook forms on the edge of front surface, and the tips of the hooks of both side plates are oppositely set; the tip has a rectangle shape with a first plane runs parallel to the front surface, a second plane perpendicular to the first plane, and a third plane which is far away from front compared with the first plane runs parallel to the first plane; the second plane and the first plane define a first edge, and the second plane and the third plane define a second edge; there is a fourth plane which is perpendicular to the third plane and defines a right angle with the third plane; the fourth plane runs parallel to the second plane, and the fourth plane is far away from hook tips compared with the second plane; the third plane and the fourth plane define the steps; the heat diffusion wing of the middle portion has a plate shape and is perpendicular to the substrate; the heat diffusion wings extend along the length direction of the profile, and each heat diffusion wing runs parallel or nearly parallel, or the heat diffusion wings are radially arranged on the substrate; and the heat diffusion wings are arranged on the whole area of the back surface of the substrate.

9. The LED street lamp of claim 8, wherein the side of the first transverse plate which faces towards the middle portion has two projecting positioning plates which are to be inserted into the clearance defined by the hook and the substrate; and another two positioning plates are also formed on the second transverse plate and function similarly; and a plurality of round holes are formed on the front of the middle portion which are used as bottom holes for connection of the head portion with middle portion, or the tail portion with the middle portion.

10. The LED street lamp of claim 1, wherein the surface of the heat diffusion wings has a plurality of projecting heat dissipation edge set along the length of the profile.

11. The LED street lamp of claim 1, wherein the head portion and the tail portion is made of aluminum or aluminum alloy by technique of die casting, and the middle portion is aluminum or aluminum alloy profile.

* * * * *